US009627800B2

(12) United States Patent
Taylor et al.

(10) Patent No.: US 9,627,800 B2
(45) Date of Patent: Apr. 18, 2017

(54) CONNECTOR WITH SPRING-LOCKED SWING ARMS

(71) Applicants: Zachary Wade Taylor, Paso Robles, CA (US); Aaron Nathan Keep, Paso Robles, CA (US); James Gus Plessas, San Luis Obispo, CA (US)

(72) Inventors: Zachary Wade Taylor, Paso Robles, CA (US); Aaron Nathan Keep, Paso Robles, CA (US); James Gus Plessas, San Luis Obispo, CA (US)

(73) Assignee: Glenair, Inc., Glendale, CA (US)

( * ) Notice: Subject to any disclaimer, the term of this patent is extended or adjusted under 35 U.S.C. 154(b) by 0 days.

(21) Appl. No.: 14/735,714

(22) Filed: Jun. 10, 2015

(65) Prior Publication Data

US 2016/0365669 A1 Dec. 15, 2016

(51) Int. Cl.
*H01R 13/56* (2006.01)
*H01R 13/58* (2006.01)

(52) U.S. Cl.
CPC ..... *H01R 13/5841* (2013.01)

(58) Field of Classification Search
CPC ..... H01R 13/5845; H01R 13/645
USPC ..... 439/470, 446
See application file for complete search history.

(56) References Cited

U.S. PATENT DOCUMENTS 4,808,123 A * 2/1989 Dee ..... H01R 13/59 439/321
5,580,278 A * 12/1996 Fowler ..... H01R 13/65802 439/321
6,116,945 A * 9/2000 Davis ..... H01R 13/5825 439/354
6,196,865 B1 * 3/2001 Ruffel ..... H01R 13/56 439/470
6,419,519 B1 * 7/2002 Young ..... H01R 13/5812 439/446
7,837,495 B2 * 11/2010 Baldwin ..... H01R 13/5804 439/446
7,862,369 B2 * 1/2011 Gimenes ..... H01R 13/5812 439/446
8,221,164 B1 * 7/2012 Lazaro, Jr. ..... H01R 9/032 439/607.41
2009/0111319 A1 * 4/2009 Baldwin ..... H01R 13/5804 439/459
2009/0111321 A1 * 4/2009 Baldwin ..... H01R 13/5829 439/471
2012/0015551 A1 * 1/2012 Tobey ..... H01R 9/035 439/460

* cited by examiner

*Primary Examiner* — Abdullah Riyami
*Assistant Examiner* — Thang Nguyen
(74) *Attorney, Agent, or Firm* — Katten Muchin Rosenman LLP

(57) ABSTRACT

A low-profile, pivotable backshell adapter assembly having flexible arms that are independently adjustable to various angles for providing strain relief to cable bundles of different sizes. The flexible arms are spring-locked into position and are adjustable without the use of tools or the removal of components. And the flexible arms apply equal inward centering force on opposing sides of an accommodated cable.

11 Claims, 15 Drawing Sheets

CONNECTOR WITH SPRING-LOCKED SWING ARMS

FIELD OF THE INVENTION

The present invention relates to a connector, such as an electrical connector, having an adapter assembly; more particularly, a backshell adapter assembly that includes one or more spring-locked and pivotable strain relief arms. The adapter assembly can be adjusted between various angles relative to the axis of the backshell adapter assembly without the use of tools or the removal of attachment components. And the arms can be flexible to provide radial clamping of cable bundles of different sizes with equally effective protection from axial forces that may damage the wire termination at the connector.

BACKGROUND

Backshell adapter assemblies are generally known in the art. Such backshell adapter assemblies normally provide a transition from a plurality of electrical conductors to an electrical connector. An example of a backshell adapter assembly is disclosed in commonly owned U.S. Pat. No. 5,580,278, hereby incorporated by reference. Backshell adapter assemblies with adjustable strain relief have been developed to accommodate wiring and connections in numerous applications. In particular, backshell adapter assemblies can provide a radial clamping force relative to a wire bundle to prevent axial forces from damaging the termination of the wires at the electrical connector, particularly for improving the space requirement for such connections. An example of a backshell adapter assembly having adjustable strain relief is disclosed in commonly owned U.S. Pat. No. 6,419,519, hereby incorporated by reference.

With the continuing development of more sophisticated systems utilizing large numbers of connections, there is a continuing need to further develop more efficient ways to accommodate the connections in terms of space usage and ease of installation and adjustment.

SUMMARY OF THE INVENTION

In view of the above, it is an object of the invention to provide a flexible, low profile adapter assembly that can be conveniently installed and adjusted.

With this in mind, the present invention is directed to a low-profile, pivotable backshell adapter assembly having flexible arms that are independently adjustable to various angles for providing strain relief to wire bundles of different sizes. The flexible arms are spring-locked into position and are adjustable without the use of tools or the removal of components. And the flexible arms apply equal inward centering force on opposing sides of an accommodated cable.

DETAILED DESCRIPTION OF THE PRESENTLY PREFERRED EXEMPLARY EMBODIMENTS

In accordance with an exemplary embodiment of the invention, a backshell adapter assembly which includes pivotable strain relief arms that are adapted to rotate between various angles, for example −90° to +90°, 0° to 90°, 0° to 45°, or the like, defined between a cable (strain relief arm or hub) axis 32 (FIG. 3) and a center axis 34 of the backshell adapter assembly. As used herein, the term configuration refers to the angular relationship between the axis 32 and the axis 34 as shown in FIG. 3. The backshell adapter assembly in accordance with the present invention eliminates the need to provide separate tooling for backshell adapter assemblies having different configurations. Not only do the pivotable strain relief arms reduce the cost of such backshell adapter assemblies but also facilitate the use of such devices. In particular, an accurate count of all of the various configurations is no longer required in order to order the backshell adapter assemblies. With the present invention, the user now need only determine the total number of backshell adapter assemblies required for the job.

Figure 5C:
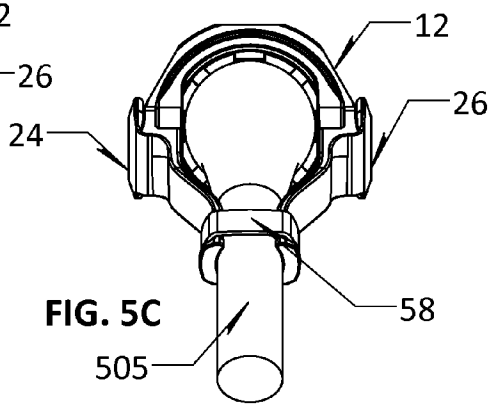
FIGS. 5A, 5B, 5C, 5D, and 5E are views of the backshell adapter assembly illustrated in FIG. 1 accommodating wire bundles of different sizes at a particular angle.
Figure 5E:
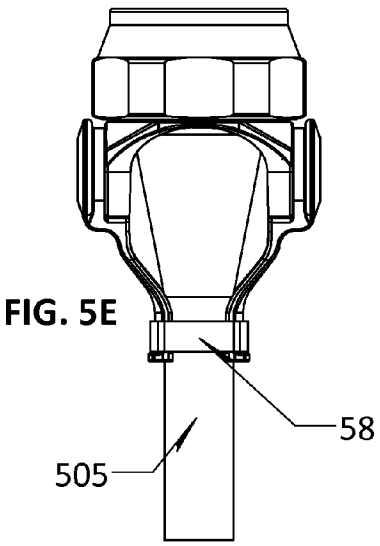
Figure 5B:
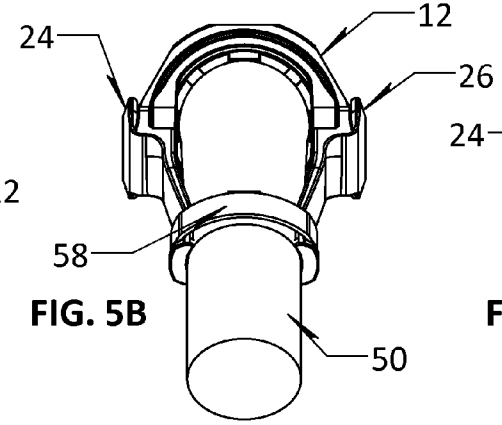
Figure 6B:
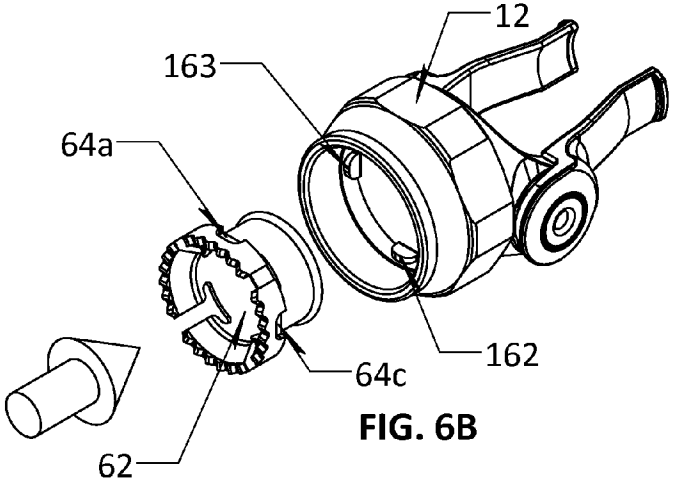
FIGS. 6A, 6B, 6C, and 6D are perspective views showing the assembly of the backshell adapter assembly illustrated in FIG. 1, in particular, that of a connector interface ferrule embodied in the assembly.
Figure 6A:
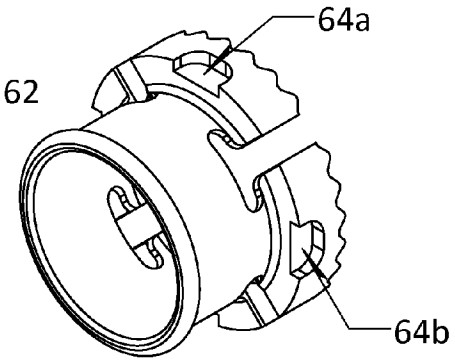
Figure 6D:
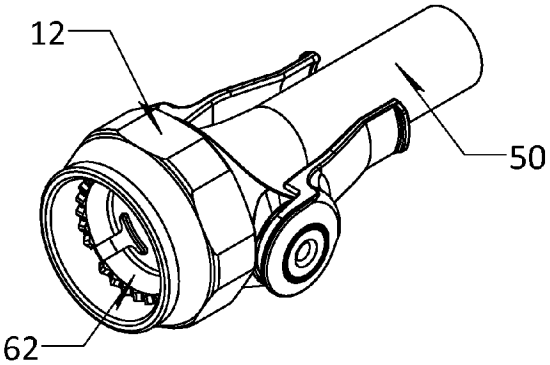
Figure 6C:
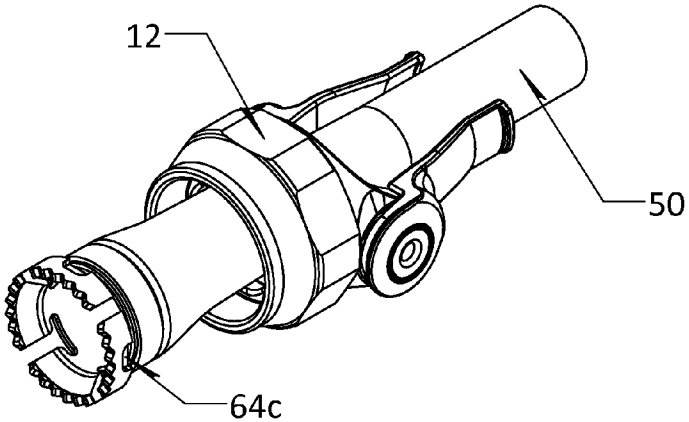
Figure 7B:
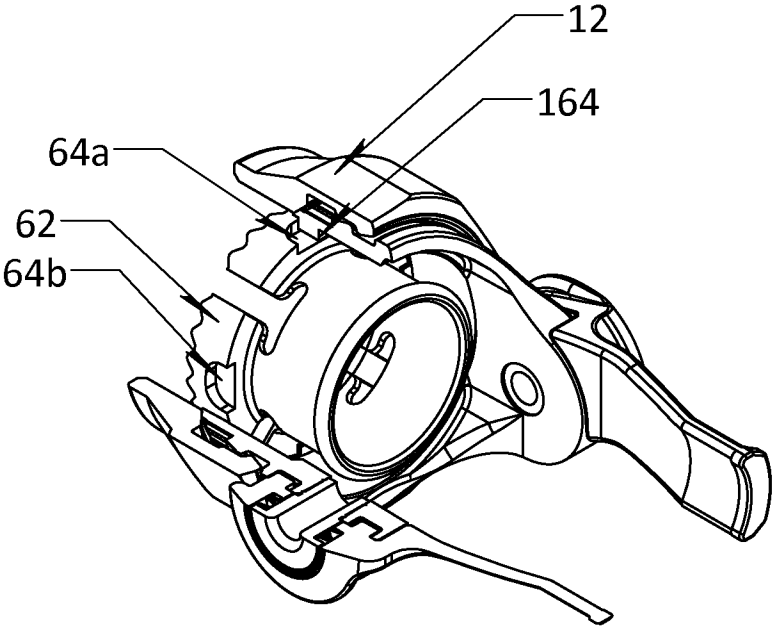
FIGS. 7A and 7B are cutaway views of a backshell adapter assembly to illustrate installation of the connector interface ferrule shown in FIG. 6A in accordance with an embodiment of the invention.
Figure 7A:
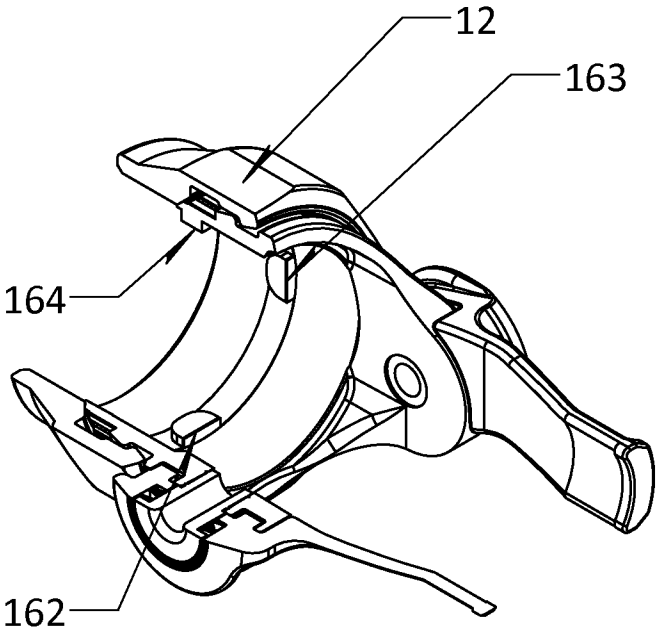
Figure 7C:
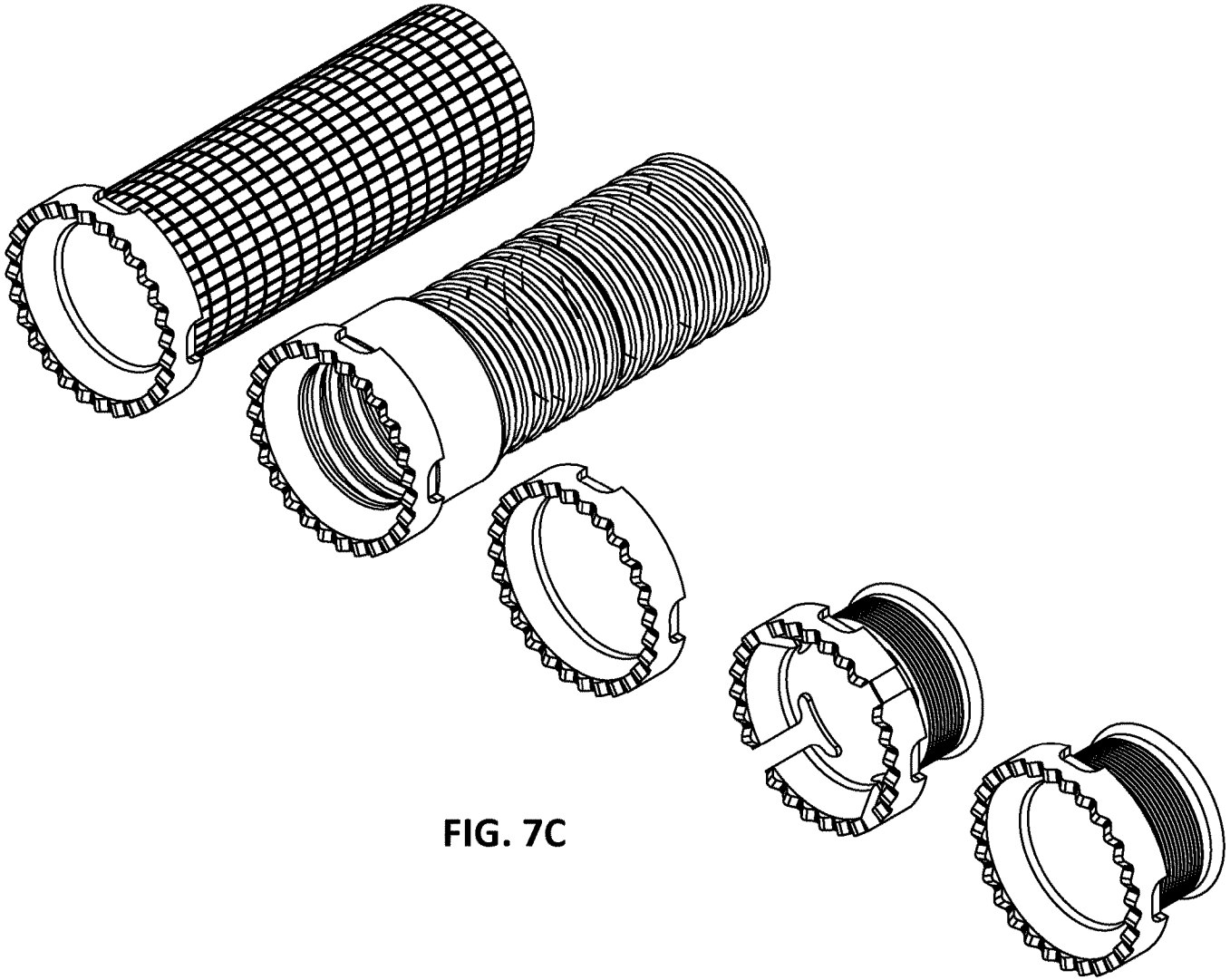
FIG. 7C illustrates alternatives to the connector interface ferrule shown in FIG. 6A in accordance with an embodiment of the invention.

Two main embodiments of the invention are illustrated. FIGS. 1 through 6C illustrate a first embodiment of a backshell adapter assembly with pivotable strain relief arms in accordance with the present invention, which are configured to be flexible for securing to cables or wire bundles of different sizes by way of a cinching cable tie. In an alternate embodiment of the invention, as illustrated in FIGS. 7A, 7B, and 7C, one or more strain relief arms may be provided with a saddle clamp to provide a radial clamping force on a cable.

The principles of the present invention are applicable to both shielded and non-shielded cable applications.

In accordance with an embodiment of the invention, a spring-lock mechanism is used to adjust the assembly to specific detent positions (configurations). The main benefit of such a spring-lock mechanism is the convenience of tool-less adjustment that does not require the removal of any attachment components for the strain relief arms. The principles of the present invention are also applicable to embodiments with various types of locking mechanisms in addition to those shown and embodiments without detent positions. It is only important that the strain relief arms be secured in place after the assembly has been configured to the desired angle. Accordingly, a backshell adapter assembly according to the present invention may have strain relief arms having shapes that are similar to those illustrated in FIGS. 1-3 but are permanently fixed in respective configurations of 0°, 45°, 90°, and the like. Such fixed configuration assemblies reduce the per unit costs and provide for convenient and reliable installation for their respective configurations.

Figure 1:
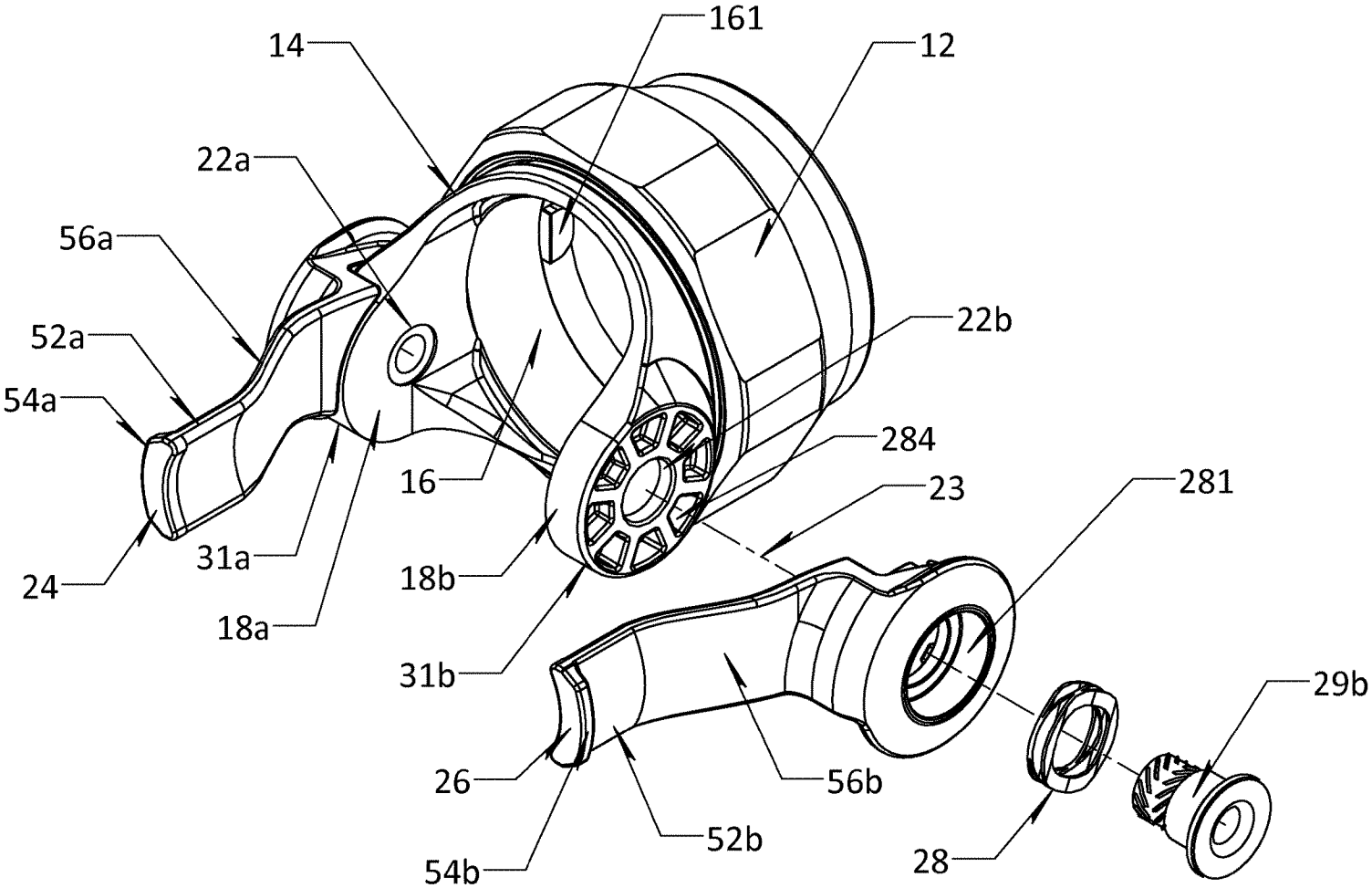
FIG. 1 is a perspective view of one embodiment of a backshell adapter assembly with a pivotable strain relief mechanism in accordance with the present invention.
Figure 5A:
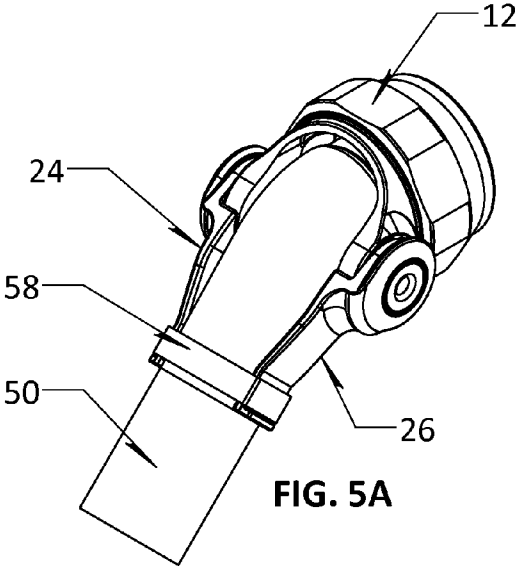
Figure 7D:
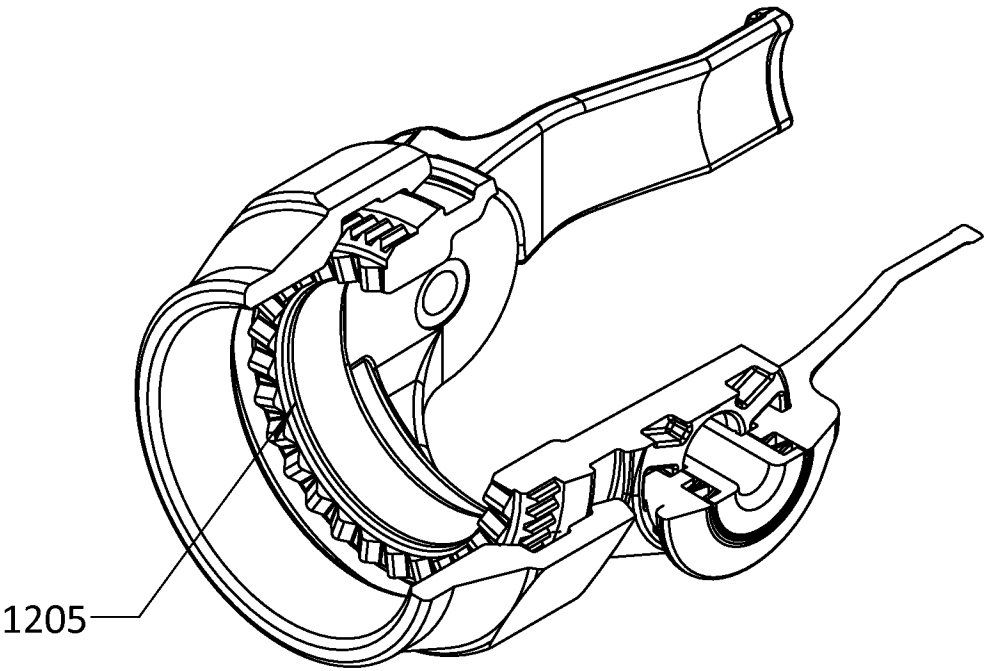
FIG. 7D is a cutaway view of a backshell adapter assembly with an integrated connector interface according to an alternative embodiment of the invention.

As shown in FIG. 1, the backshell adapter assembly with pivotable strain relief arms in accordance with an exemplary embodiment of the present invention is generally identified with the reference numeral 12. The backshell adapter assembly 12 includes a body 14 formed, for example, from various materials, such as an aluminum alloy, stainless steel or a composite plastic material. The body 14 includes a ring (cylindrical) portion 16 and two opposing rounded protrusions with flat portions 18*a* and 18*b*. The flat portions 18*a* and 18*b* are spaced apart and disposed to be generally parallel to the axis 34. The spacing between the flat portions 18*a* and 18*b* as well as the diameter of the ring portion 16 are selected to receive at least a shielded cable 50 of the size shown in FIGS. 5A and 5B, or a smaller cable 505 as shown in FIG. 5C. The ring portion 16 is configured to accommodate a connector interface ferrule 62, as shown in FIGS. 6A through 6C. The connector interface ferrule 62 is secured to the cable 50 and does not form a part of the backshell adapter assembly 12. In particular, ring portion 16 may include axially extending tabs (for example, tabs 161, 162, 163, and 164 shown in FIGS. 1, 2, 6B, 7A, and 7B) to cooperate with corresponding slots 64*a*, 64*b*, and 64*c*, shown in FIGS. 6A, 6B, and 7B formed in the connector interface ferrule 62 (slot 64*d* not shown). The connector interface ferrule 62—and, in particular, the slots 64*a*-*d* formed therein—cooperate with the tabs 161, 162, 163, and 164 on the ring portion 16 of the body 14 to prevent rotation of the cable 50 relative to the backshell adapter assembly 12. FIG. 7C further illustrates alternative embodiments for connector interface ferrule 62, which may be implemented using a braid sock, conduit, direct interface, slotted banding porch, banding porch, and the like. According to another exemplary embodiment of the invention, a backshelll adapter assembly 1205, as shown in FIG. 7D, may include an integrated connector interface that similarly prevents rotation of a cable but does not require a separate connector interface ferrule 62.

Figure 2:
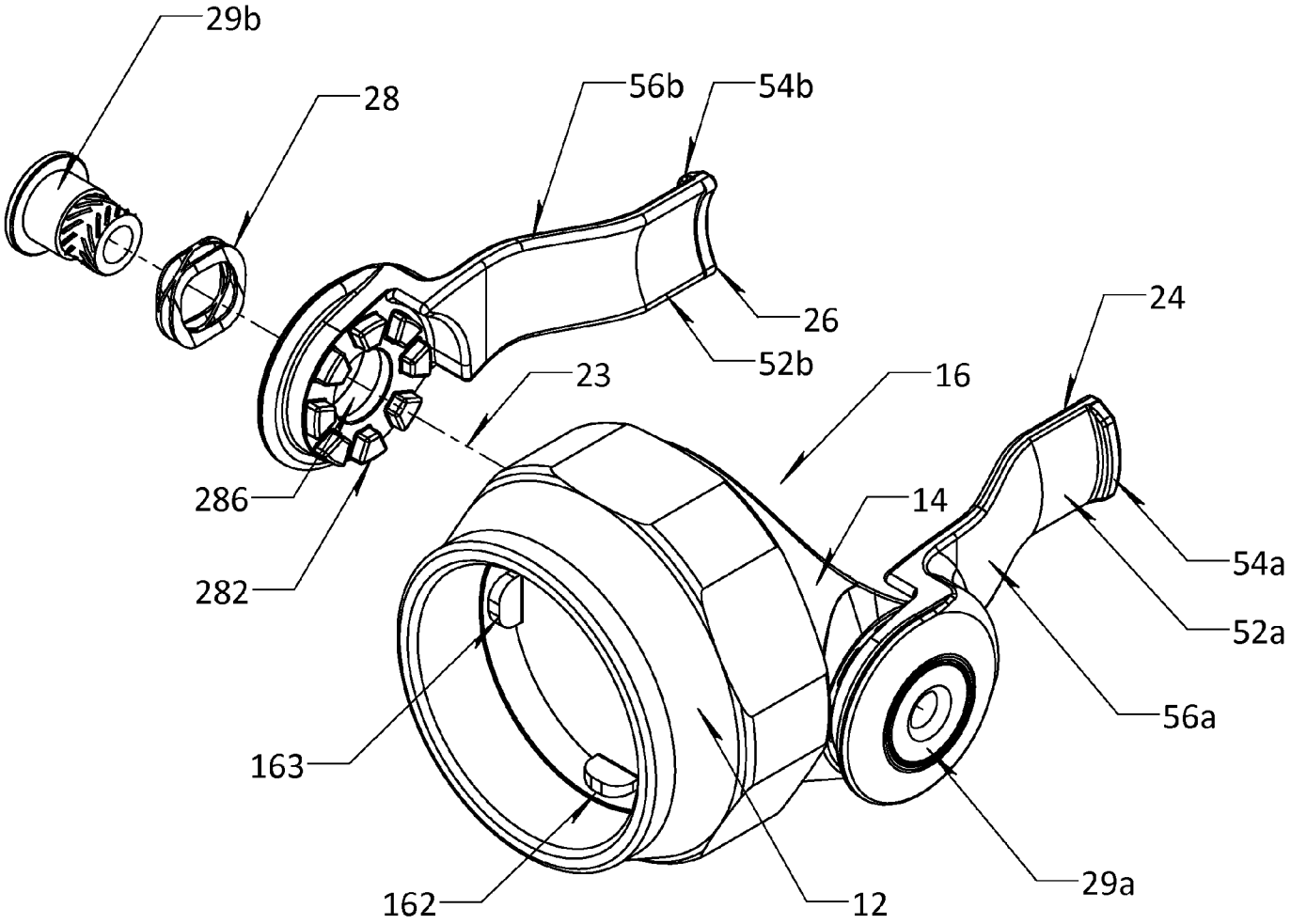
FIG. 2 is another perspective view of the backshell adapter assembly illustrated in FIG. 1.

The flat portions 18*a* and 18*b* of the body 14 are provided with aligned apertures 22*a* and 22*b* which define a pivot axis 23. These apertures 22*a* and 22*b* are used to attach a pair of opposing strain relief arms 24 and 26 to the body 14 that are pivotable around pivot axis 23 (to form rotational hubs of strain relief arms 24 and 26. The strain relief arms 24 and 26 are each secured to the body 14 using fasteners 29*a* and 29*b* that attach through the corresponding apertures 22*a* and 22*b*. As shown in FIGS. 1 and 2, to allow for adjustment of the assembly between configurations without having to disable the assembly, a biasing member 28 is received in the recess 281 of the strain relief arm 26 and is supported by the fastener 29*b*. Strain relief arm 24 may be attached to body 14 in a similar manner. The following description is, thus, directed to the analogous assembly of both strain relief arms 24 and 26 with reference to the illustration of strain relief arm 26 in FIGS. 1 and 2.

The biasing member 28 is preferably a compression spring. And the bias (e.g., spring force) of the biasing member 28 pushes the strain relief arm 24 and 26 towards the corresponding flat portion 18*a* and 18*b*. In this manner, for example, protrusions 282 disposed on the strain relief arm 26 are aligned with and engage corresponding circumferential recesses 284 arc radially disposed along extending arcuate surfaces 31*b* of the flat portion 18*b* and all around aperture 22*b*. With the aligned engagement of the protrusions 282 and recesses 284, the bias of the biasing member 28 locks the strain relief arm 26 at various detent configuration angles relative to the body 14. Eight recesses 284 are shown to provide for secure engagement with the strain relief arm 26 while allowing its adjustment, as described below, in 45° increments. More or less recesses and corresponding protrusions on strain relief arms 24 and 26 may be used, for example, to accommodate different adjustment increments. In other words, some of the protrusions 282 and recesses 284 may be omitted when certain detent positions are not desired—for example, limiting the strain relief arms 24 and 26 to two or more of 0°, 45°, and 90° in one direction.

In the exemplary embodiment illustrated, the strain relief arms 24 and 26 are each provided with an aperture (286 for strain relief arm 26 shown in FIG. 2). These apertures are adapted to be aligned with the aperture 22*a* and 22*b* in the flat portions 18*a* and 18*b*, respectively, of the body 14 to enable the strain relief arms 24 and 26 to be pivotably coupled to the body 14 with suitable fasteners 29*a* and 29*b*. The fasteners 29*a* and 29*b* may be pins, rivets or screws or any means which enables the strain relief arms 24 and 26 to pivot with respect to the body 14. Again, in the embodiments illustrated, the strain relief arms 24 and 26 are provided with spaced apart protrusions 282 that are adapted to be aligned with the recesses 284 along the extending arcuate surfaces 31*a* and 31*b* of the flat portions 18*a* and 18*b* of the body 14 and all around apertures 22*a* and 22*b*. These protrusions 282 enable the strain relief arms 24 and 26 to be secured at a selected configuration angle relative to the body 14—i.e., angle between axes 32 and 34 illustrated in FIG. 3B—by way of spring-locked engagement with recesses 284.

Figure 3B:
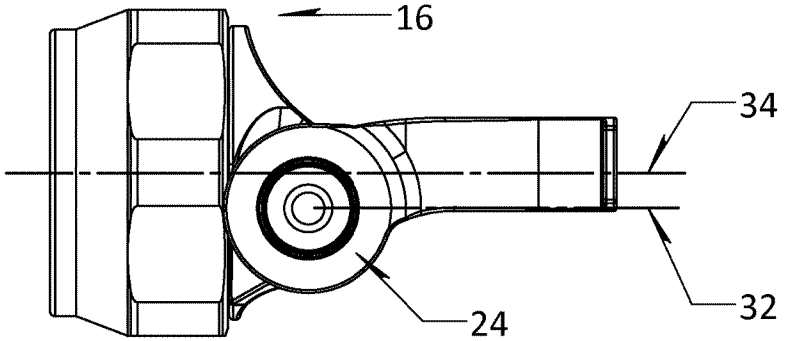
FIGS. 3A, 3B, 3C, and 3D are respective views of the backshell adapter assembly illustrated in FIG. 1, with an illustration of the manner of adjusting the swing arms of the backshell adapter assembly.
Figure 3C:
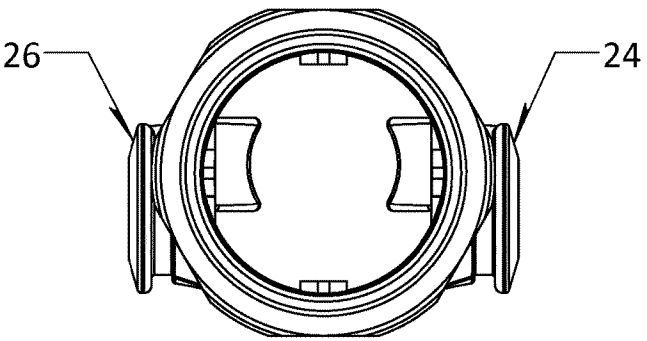
Figure 3A:
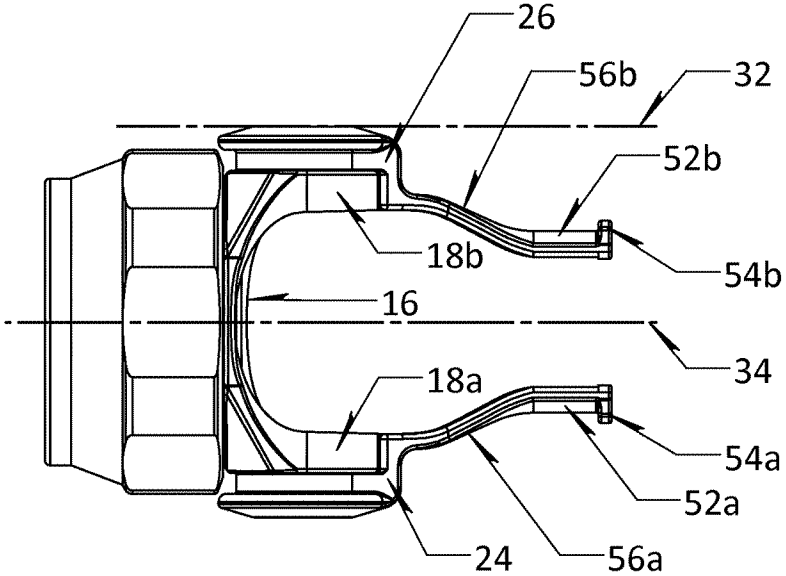
Figure 3D:
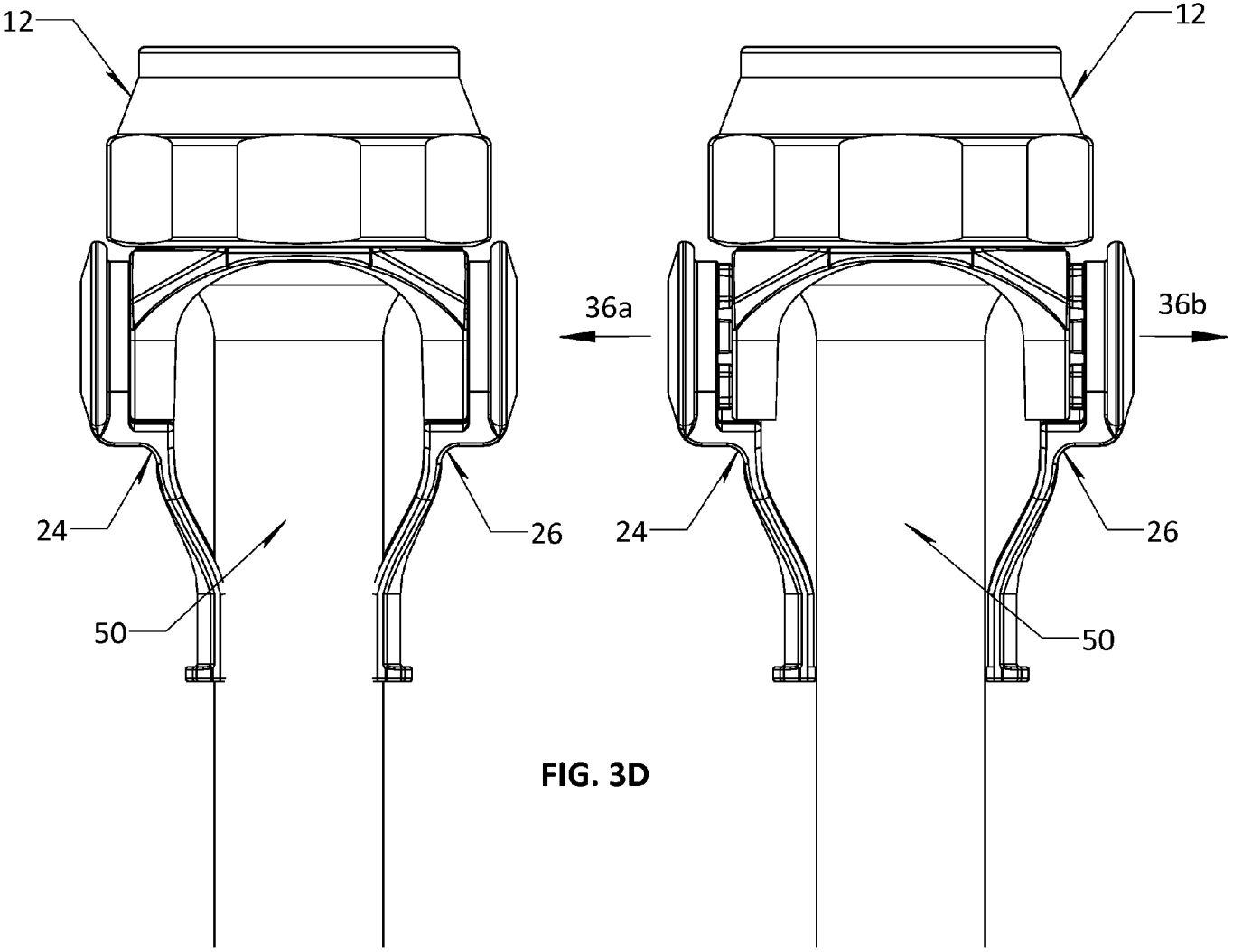
Figure 4B:
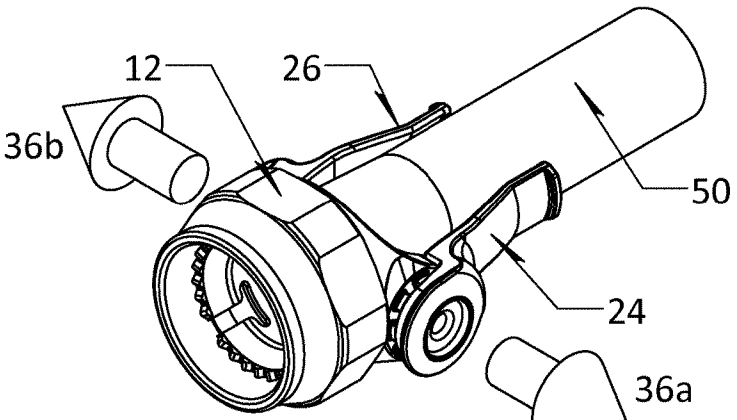
FIGS. 4A, 4B, 4C, 4D, and 4E are alternate perspective views of the backshell adapter assembly illustrated in FIG. 1 showing an adjustment of the swing arms from a 0 degree orientation to a 45 degree orientation and swing arms attached to the bundle by means of a cinching cable tie.
Figure 4A:
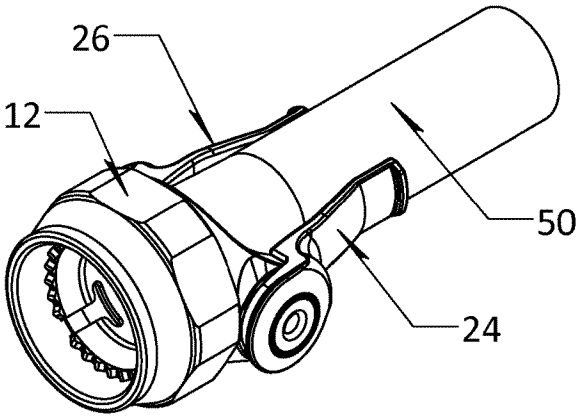
Figure 4C:
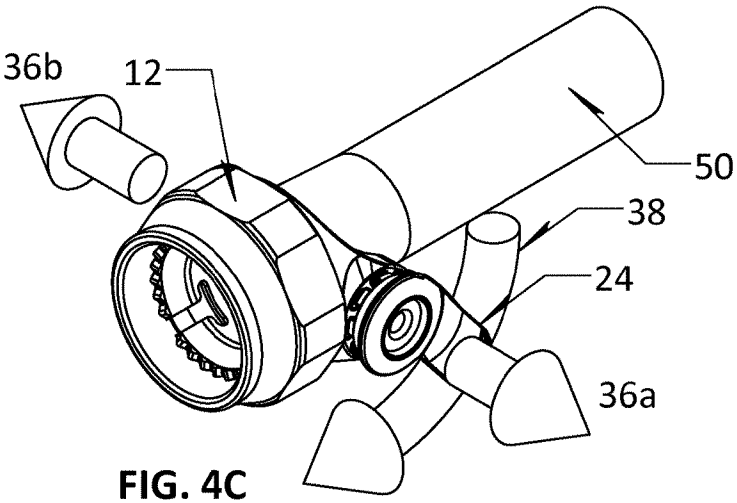
Figure 8B:
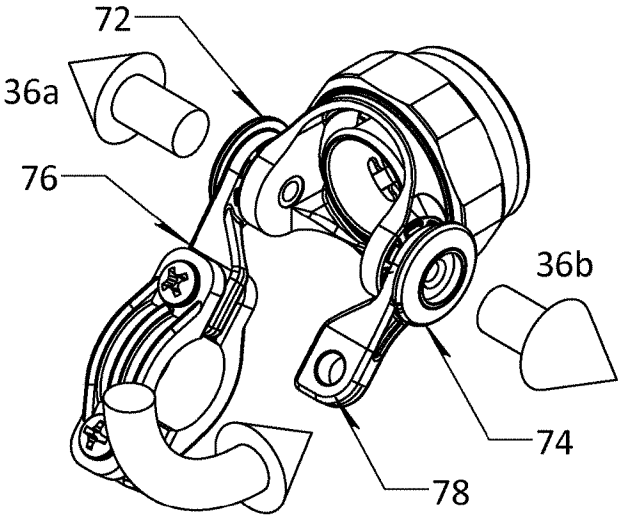
FIGS. 8A, 8B, and 8C are perspective views of a backshell adapter assembly in accordance with an alternative embodiment of the invention.

As seen in FIGS. 3D, 4B, and 8B, by pulling the strain relief arms 24 and 26 outward away from the flat portions 18*a* and 18*b* of the body 14 (as illustrated by arrows 36*a* and 36*b*) against the bias of the biasing member 28, the strain relief arms 24 and 26 move out of engagement with the flat portion 18 and 18*b* via protrusions 282 and recesses 284, allowing the strain relief arms 24 and 26 to pivot with respect to the body 14 in the directions denoted by arrows 38 (shown in FIG. 4C) to a selected position, such as the exemplary configurations shown in FIGS. 4A-4E. Once a configuration (detent angle) is selected, the pulling force may be released and the biasing member 28 forces the protrusions 282 of strain relief arms 24 and 26 back into engagement with the recesses 284 of the flat portions 18*a* and 18*b* to lock the strain relief arms 24 and 26 in place.

As seen in FIGS. 4A-4E, by releasing the pulling force illustrated by arrows 36*a* and 36*b* as described above, the strain relief arms (24 and 26) and the cable 50 can be pivoted with respect to the backshell adapter assembly 12 to any desired position. The exemplary embodiment of the protrusions 282 and corresponding recesses 284 allows for adjustment of the cable position in 45° increments. Again, alternative arrangements of the engagement mechanism may be used to provide for different adjustment increments. The locking protrusions 282 and recesses 284 ensure that once a cable position is selected, the backshell adapter assembly position is locked into that position. In this way, the strain relief arms 24 and 26 may be adjusted without the use of any specialized tools or the removal of any components, such as fastener 29 and the like, for attaching the strain relief arms 24 and 26 to the backshell adapter assembly 12. Other configurations may include different locking mechanisms and strain relief arms 24 and 26 that are integrated with body 14 as one piece. The integrated arms may be disposed at 0°, 45°, or 90° from the center axis 34. All such configurations are considered to be within the broad scope of the invention.

Figure 3F:
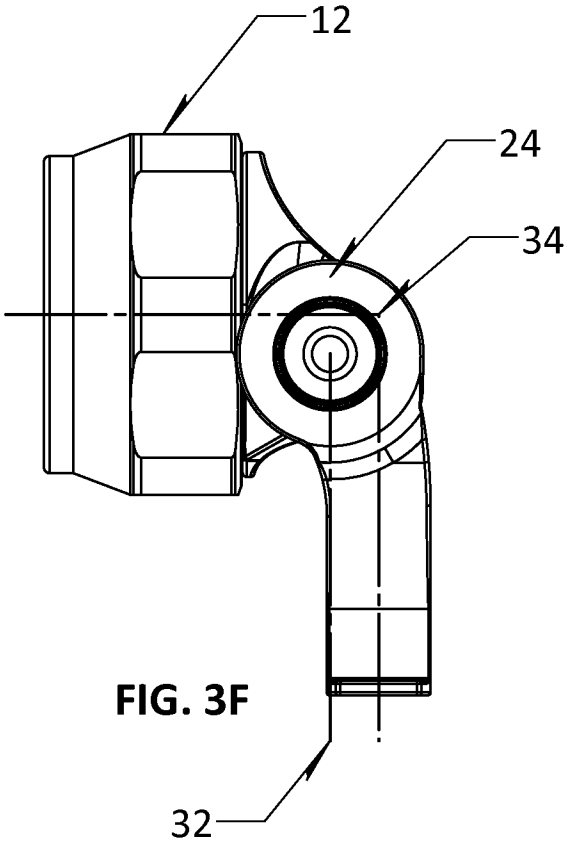
FIGS. 3E and 3F are side views of a backshell adapter assembly with a pivot axis (or hub centerline) offset according to an embodiment of the invention.
Figure 3E:
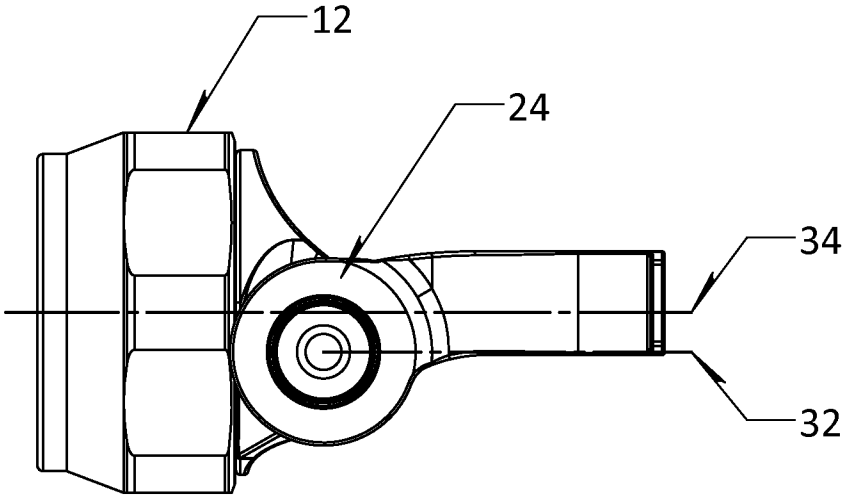
Figure 4E:
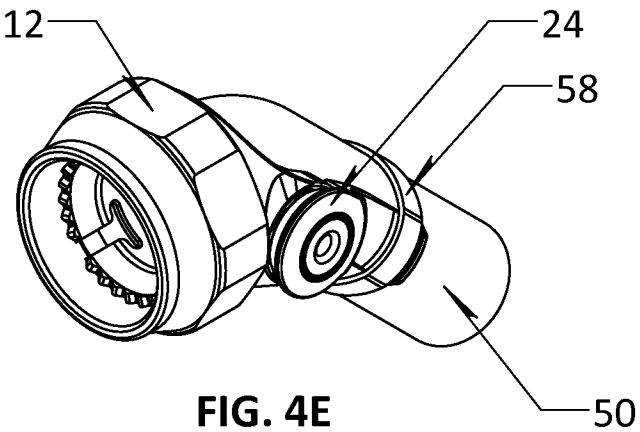
Figure 4D:
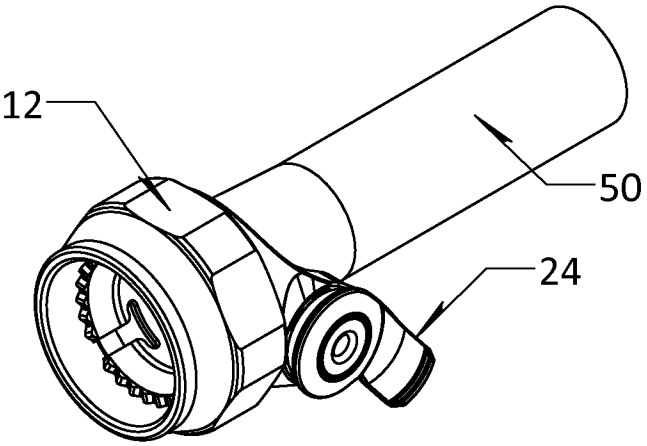

Referring back to FIGS. 1-3A, the strain relief arms 24 and 26 are configured with notches 52*a* and 52*b*, respectively, disposed between stops (54*a* and 54*b*) and shoulders (56*a* and 56*b*). The configuration is adapted to capture a cable tie 58, as shown in FIGS. 4E and 5A-C, within the notches 52*a* and 52*b* to enable the strain relief arms 24 and 26 to be secured to the cable 50. And as shown in FIGS. 5B and 5C, the strain relief arms 24 and 26 are made with flexible material, such as, but not limited to, a composite material, so that they can be flexed to fit cables and wire bundles of different sizes. And the cables and wire bundles of different sizes can be conveniently accommodated by simply using different sized cable ties to secure the strain relief arms 24 and 26 thereto.

Figure 5D:
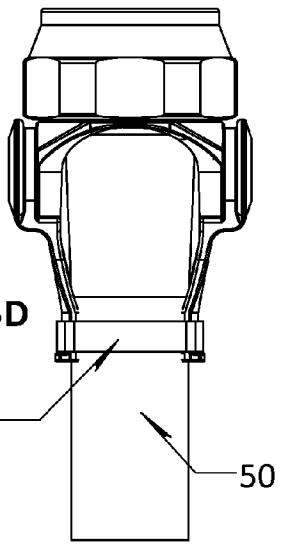

FIGS. 5B-5D further illustrate the strain relief arms 24 and 26 according to an exemplary embodiment of the invention being flexibly adjusted to cables and wire bundles of different sizes. As shown in FIGS. 5B-5D, while the strain relief arms 24 and 26 may be flexed to different degrees for accommodating cables/wire bundles 50 of different sizes, their flexion apply equal force to opposing sides of cable/wire bundle 50 such that they act to center the cable/wire bundle 50, for example, to run along center axis 34 backshell adapter assembly 12 shown in FIGS. 3A and 3B in the 0 degree configuration. And the cable/wire bundle 50 would be bent away from the center axis 34 only in the direction of the strain relief arm angled configurations—for example, as shown in FIGS. 4E and 5A.

FIGS. 1 and 2 also illustrate apertures 22*a* and 22*b* of flat portions 18*a* and 18*b* defining a pivot axis 23 for the strain relief arms 24 and 26 that intersects the center axis 34. In an alternative embodiment illustrated in FIGS. 3A-4E, flat portions 18*a* and 18*b* may be offset from the center axis 34 such that a pivot axis for the strain relief arms 24 and 26 does not intersect the center axis 34 but is, instead, offset from it. For example, as shown in FIG. 3B, while axes 32 and 34 may be parallel with each other in the 0 degree configuration, they do not overlap. Axis 32—i.e., strain relief arms 24 and 26—is offset from the center axis 34 through ring portion 16 of assembly 12 for accommodating wire bundle 50. Thus, referring back to FIGS. 4A to 4E, the offset of strain relief arms 24 and 26 results in a more gradual bend to the cable or wire bundle in rotated (45 degree) configuration illustrated in FIG. 4E. In addition, as shown in FIGS. 3E and 3F, the offset of strain relief arms 24 and 26 also reduces the profile of the backshell adapter assembly 12. In other words, in the 90 degree configuration illustrated in FIG. 3F, the lengths of strain relief arms 24 and 26 may be reduced for an equivalent configuration height of an assembly with non-offset strain relief arms, thus shortening the straight configuration length (assembly profile) illustrated in FIG. 3E.

Figure 8A:
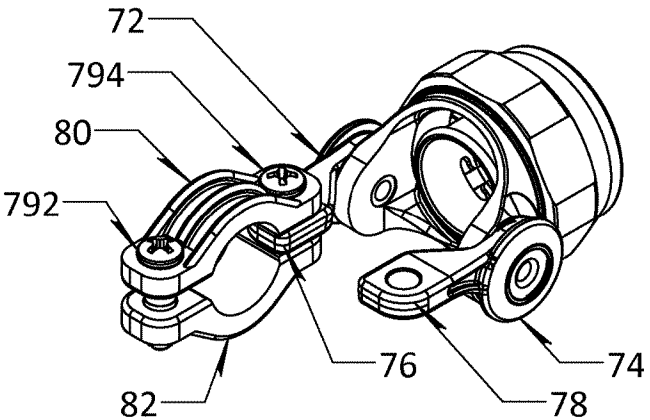
Figure 8C:
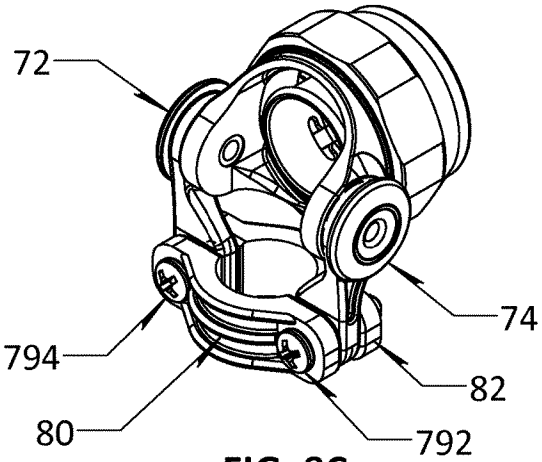

FIGS. 8A, 8B, and 8C illustrate an alternative embodiment of the invention. As shown in FIGS. 8A, 8B, and 8C, strain relief arms 72 and 74 may be formed with extending flange portions 76 and 78. These extending flange portions 76 and 78 may be used to secure a pair of opposing saddle bars 80 and 82. Each of the saddle bars 80 and 82 may be formed with apertures that are adapted to be aligned with apertures on the flange portions 76 and 78 to enable the saddle bars 80 and 82 to be secured to the strain relief arms 72 and 74 with suitable fasteners, for example, a pair of screws 792 and 794. In a configuration as illustrated in FIG. 8C, saddle bars 80 and 82 attached to extending flange portions 76 and 78 may cooperate to wrap around a cable or wire bundle in an analogous manner to the strain relief arms 24 and 26 and cable tie 58.

Figure 9B:
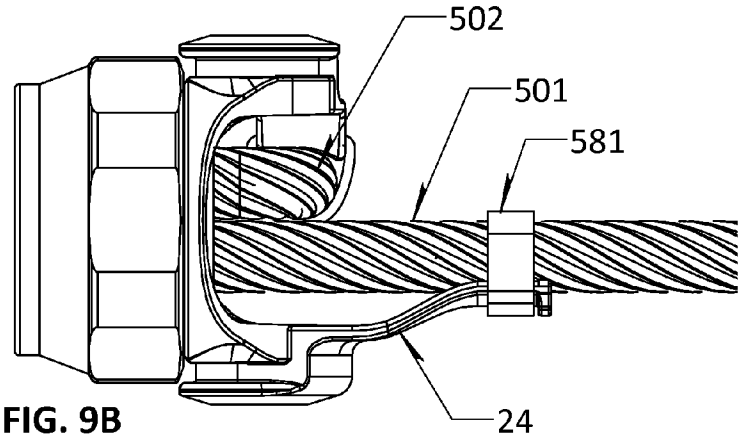
FIGS. 9A, 9B, and 9C are views of the backshell adapter assembly illustrating strain relief arms configured at different angles.
Figure 9C:
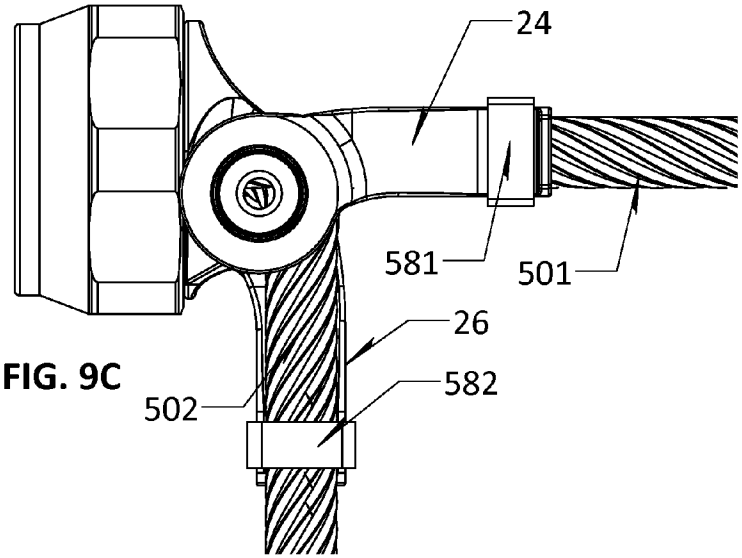
Figure 9A:
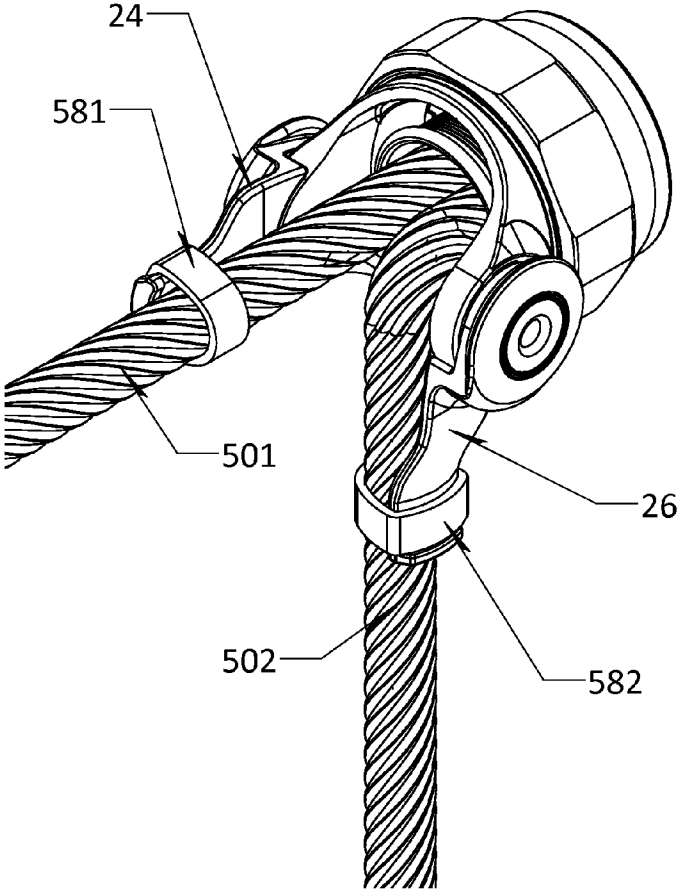

According to an alternative embodiment, the backshell adapter assembly 12 may include only one strain relief arm or the strain relief arms 24 and 26 may be configured in different detent positions for accommodating respective cables or wire bundles with a corresponding cable tie wrapping the respective cables or wire bundles to each of the strain relief arms 24 and 26 around notches 52*a* and 52*b*, respectively. For example, as shown in FIGS. 9A, 9B, and 9C, strain relief arms 24 and 26 may be configured at different angles for accommodating respective cables/wire bundles 501 and 502 using respective cable ties 581 and 582. In the example shown, strain relief arm 24 is in the 0 degree configuration and strain relief arm 26 is in the 90 degree configuration. Again, any combination of configurations of the strain relief arms 24 and 26 may be used.

Figure 10:
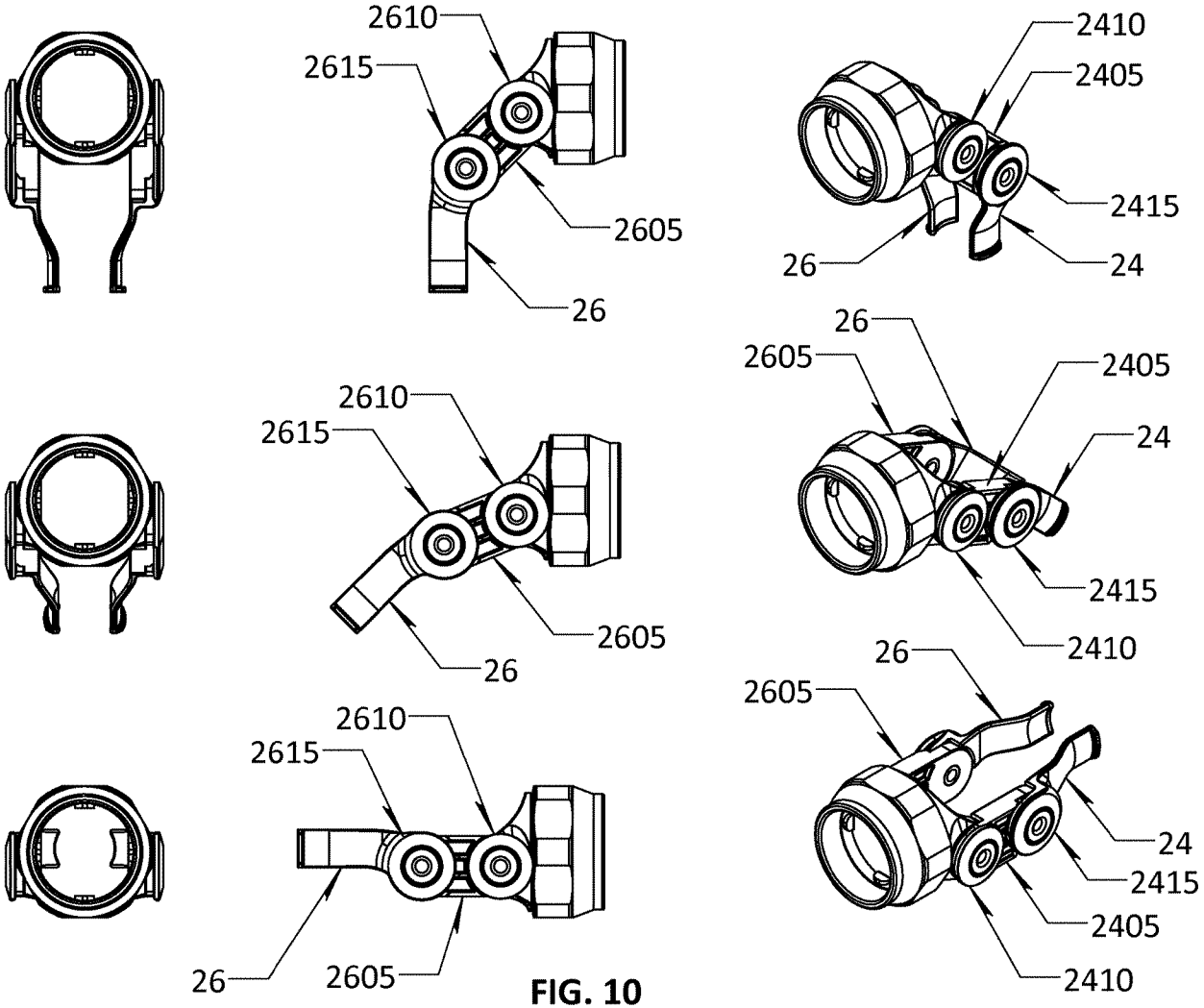
FIG. 10 illustrates a backshell adapter assembly with pivotable extension arms in accordance with an alternative embodiment of the invention.

According to another alternative embodiment of the invention, the strain relief arms 24 and 26 may be coupled to the backshell adapter assembly 12 via one or more sets of pivotable extensions (arms). As shown in FIG. 10, strain relief arms 24 and 26 may be coupled to extension arms 2405 and 2605, respectively, in the manner illustrated in FIGS. 1 and 2 in connection with bias member 28, fasteners 29*a* and 29*b*, and interlocking elements 282 and 284 (denoted with reference numerals 2415 and 2615, respectively). And extension arms 2405 and 2605 may, in turn, be coupled to backshell adapter assembly 12 in a similar manner (2410 and 2610). Thus, as shown in FIG. 10, extension arms 2405 and 2605 may be configured at 45 degrees while strain relief arms 24 and 26 are configured at 90 degrees, resulting in a more gradual bend for any cable/wire bundle accommodated in this configuration, which is particularly advantageous for accommodating larger and more rigid cables/wire bundles.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

All U.S. and foreign patents and patent applications discussed above are hereby incorporated by reference into the Detailed Description of the Preferred Embodiments.

The invention claimed is:

1. An adapter assembly for connecting a cable to an apparatus, the adapter assembly comprising:

a cylindrical portion configured to interface with a connector that connects to the cable, the cylindrical portion defining a center axis;

a pair of flat portions extending from opposing sides of the cylindrical portion, each of the flat portions comprising:

a center aperture configured to receive a fastener, the center aperture defining a pivot axis; and a plurality of recesses surrounding the center aperture; and a pair of strain relief arms each comprising:

a recess configured to receive the fastener and a bias member for pivotable attachment to a corresponding one of the pair of flat portions;

a plurality of protrusions configured to engage the plurality of recesses in a plurality of predetermined angular configurations of each strain relief arm, each of the plurality of predetermined angular configurations defining an angle between each strain relief arm and the center axis; and a flexible end with an inward bend when attached to the corresponding one of the pair of flat portions, wherein each of the bias members exerts an inward force on a corresponding one of the pair of strain relief arms towards the center axis, when an opposing outward force is exerted on one or more of the strain relief arms, the plurality of protrusions of the one or more strain relief arms disengage from the plurality of recesses, allowing a pivot rotation of the one or more strain relief arms to another of the plurality of predetermined angular configurations, and each of the flexible ends are configured to be attached to the cable with each inward bend exerting an inward force on the attached cable.

2. The adapter assembly of claim 1, wherein the angle is selected from: 0 degrees, 45 degrees, and 90 degrees.

3. The adapter assembly of claim 1, wherein the center aperture is offset from the center axis.

4. The adapter assembly of claim 1, wherein the center aperture is aligned with the center axis.

5. An adapter assembly for connecting a cable to an apparatus, the adapter assembly comprising:

a cylindrical portion configured to interface with a connector that connects to the cable, the cylindrical portion defining a center axis;

a pair of flat portions extending from opposing sides of the cylindrical portion, each of the flat portions comprising:

a center aperture configured to receive an arm fastener, the center aperture defining a pivot axis; and a plurality of recesses surrounding the center aperture; and a pair of strain relief arms each comprising:

a recess configured to receive the arm fastener and a bias member for pivotable attachment to a corresponding one of the pair of flat portions;

a plurality of protrusions configured to engage the plurality of recesses in a plurality of predetermined angular configurations of each strain relief arm, each of the plurality of predetermined angular configurations defining an angle between each strain relief arm and the center axis; and a flange portion configured to receive a saddle bar fastener for fastening a pair of saddle bars to the flange portion, wherein each of the bias members exerts an inward force on a corresponding one of the pair of strain relief arms towards the center axis, when an opposing outward force is exerted on one or more of the strain relief arms, the plurality of protrusions of the one or more strain relief arms disengage from the plurality of recesses, allowing a pivot rotation of the one or more strain relief arms to another of the plurality of predetermined angular configurations, and the pair of saddle bars fastened to the flange portions of each of the strain relief arms form a circumference around the cable.

6. The adapter assembly of claim 5, wherein the angle is selected from: 0 degrees, 45 degrees, and 90 degrees.

7. The adapter assembly of claim 5, wherein the center aperture is offset from the center axis.

8. The adapter assembly of claim 5, wherein the center aperture is aligned with the center axis.

9. An adapter assembly for connecting a cable to an apparatus, the adapter assembly comprising:

a cylindrical portion configured to interface with a connector that connects to the cable, the cylindrical portion defining a center axis; and a pair of strain relief arms each with a flexible end having an inward bend, wherein each of the flexible ends is configured to be attached to the cable with each inward bend exerting an inward force on the attached cable, each of the strain relief arms comprising:

engagement means for engaging complementary engagement structure disposed on the cylindrical portion, wherein, when an opposing outward force is exerted on one or more of the flexible ends, the corresponding engagement means disengages from the corresponding engagement structure, allowing a pivot rotation of the one or more flexible ends to another of a plurality of angular configurations, and each of the strain relief arms extend from the cylindrical portion to form one of the plurality of angles with the center axis selected from: 0 degrees, 45 degrees, and 90 degrees.

10. An adapter assembly for connecting a cable to an apparatus, the adapter assembly comprising:

a cylindrical portion configured to interface with a connector that connects to the cable, the cylindrical portion defining a center axis;

a pair of first flat portions extending from opposing sides of the cylindrical portion, each of the first flat portions comprising:

a first center aperture configured to receive a first fastener, the first center aperture defining a first pivot axis; and a plurality of first recesses surrounding the first center aperture;

a pair of extension arms each comprising:

a first recess configured to receive the first fastener and a first bias member for pivotable attachment to a corresponding one of the pair of first flat portions;

a plurality of first protrusions configured to engage the plurality of first recesses in a plurality of first angular configurations of each extension arm, each of the plurality of first angular configurations defining a first angle between each extension arm and the center axis;

a second center aperture configured to receive a second fastener, the second center aperture defining a second pivot axis; and a plurality of second recesses surrounding the second center aperture; and a pair of strain relief arms each comprising:

a second recess configured to receive the second fastener and a second bias member for pivotable attachment to a corresponding one of the pair of extension arms;

a plurality of second protrusions configured to engage the plurality of second recesses in a plurality of second angular configurations of each strain relief arm, each of the plurality of second angular configurations defining a second angle between each strain relief arm and the corresponding one of the pair of extension arms; and a flexible end with an inward bend when attached to the corresponding one of the pair of extension arms, wherein each of the first bias members exerts an inward force on a corresponding one of the pair of extension arms towards the center axis, when an opposing outward force is exerted on one or more of the extension arms, the plurality of first protrusions of the one or more extension arms disengage from the plurality of first recesses, allowing a pivot rotation of the one or more extension arms to another of the plurality of first angular configurations, wherein each of the second bias members exerts an inward force on a corresponding one of the pair of strain relief arms towards the center axis, when an opposing outward force is exerted on one or more of the strain relief arms, the plurality of second protrusions of the one or more strain relief arms disengage from the plurality of second recesses, allowing a pivot rotation of the one or more strain relief arms to another of the plurality of second angular configurations, and and each of the flexible ends are configured to be attached to the cable with each inward bend exerting an inward force on the attached cable.

11. The adapter assembly of claim 10, wherein the first and second angles are each selected from: 0 degrees, 45 degrees, and 90 degrees.

* * * * *